US010679547B2

(12) United States Patent
Zeng

(10) Patent No.: US 10,679,547 B2
(45) **Date of Patent: *Jun. 9, 2020**

(54) RGB LIGHT STRIPS DISPLAY METHOD AND DISPLAY DEVICE

(71) Applicant: Shenzhen Tunkey Technology Co., Ltd., Shenzhen (CN)

(72) Inventor: RongYue Zeng, Shenzhen (CN)

(73) Assignee: Shenzhen Tunkey Technology Co., Ltd., Shenzhen (CN)

( * ) Notice: Subject to any disclaimer, the term of this patent is extended or adjusted under 35 U.S.C. 154(b) by 0 days.

This patent is subject to a terminal disclaimer.

(21) Appl. No.: 16/164,100

(22) Filed: Oct. 18, 2018

(65) Prior Publication Data

US 2019/0139483 A1 May 9, 2019

(30) Foreign Application Priority Data

Nov. 8, 2017 (CN) ..... 2017 1 1089370

(51) Int. Cl.
*G09G 3/00* (2006.01)
*G09G 3/32* (2016.01)

(52) U.S. Cl.
CPC ..... *G09G 3/32* (2013.01); *G09G 3/005* (2013.01); *G09G 2310/0224* (2013.01);
(Continued)

(58) Field of Classification Search
CPC ... G09G 2310/0224; G09G 2320/0242; G09G 2320/0666; G09G 2340/0407; G09G 2340/0435; G09G 3/005; G09G 3/32
See application file for complete search history.

(56) References Cited

U.S. PATENT DOCUMENTS

2015/0357315 A1* 12/2015 Oraw ..... H01L 25/0753 315/294
2017/0061919 A1* 3/2017 Chen ..... G02F 1/0105

FOREIGN PATENT DOCUMENTS

CN 101866598 A 10/2010
CN 203659361 U 6/2014
(Continued)

*Primary Examiner* — Insa Sadio
(74) *Attorney, Agent, or Firm* — Dinsmore & Shohl LLP; Thomas Anderson; Jeremy J. Justice

(57) ABSTRACT

The present application provides an RGB light strips display method, device and computer readable storage medium, wherein the method comprises: establishing a mapping relationship between each odd and even pixel positions in the rotation display area of the alternating RGB light strips and each odd and even pixel points in the image to be displayed, and generates an alternating radius scanning coordinate conversion table; wherein the alternating RGB light strips is composed of two RGB light strips intersected, the RGB light strips is composed of an odd radius light strip and an even radius light strip, the odd radius light strip is used to display odd pixel points in the image to be displayed, the even radius light strip is used to scan the even pixel points in the image to be displayed; and then, according to the alternating radius scanning coordinate conversion table, the pixel point sampling is performed on the image to be displayed to obtain the displayed chrominance information corresponding to the each odd and even pixel positions in the rotation display area; finally, in the process of rotating the alternating RGB light strips, according to the current rotational angle of the alternating RGB light strips and the displayed chrominance information corresponding to the each odd and even pixel positions in the rotation display area to extract and refresh the RGB light strips display data. The present application can exhibit a naked eye stereoscopic display effect.

10 Claims, 5 Drawing Sheets

(52) U.S. Cl.
CPC ..... *G09G 2320/0242* (2013.01); *G09G 2320/0666* (2013.01); *G09G 2340/0407* (2013.01); *G09G 2340/0435* (2013.01)

(56) References Cited

FOREIGN PATENT DOCUMENTS

| | | | |
|---|---|---|---|
| CN | 104732592 | A | 6/2015 |
| CN | 105845050 | B | 1/2019 |
| JP | 2004233950 | A | 8/2004 |
| WO | 2002054134 | A1 | 7/2002 |

* cited by examiner

RGB LIGHT STRIPS DISPLAY METHOD AND DISPLAY DEVICE

CROSS REFERENCE TO RELATED APPLICATIONS

This application claims priority to Chinese Patent Application No. 201711089370.7, filed on Nov. 8 2017, entitled "an alternating sampling and rotating RGB light strips display method, a device and computer readable storage medium", which is hereby incorporated by reference into this application as if fully set forth herein.

FIELD OF THE INVENTION

The present application relates to the technical field of image display, and especially to a RGB light strips display method and a display device.

BACKGROUND OF THE INVENTION

As a common information transmission tool, LED display can greatly display information to people, and play the role of prompting and decoration. However, the existing LED display screens are mostly based on dot matrix array scanning or liquid crystal ranks scanning, and the naked eye intuitive feeling presented to the user is a flat effect, and can not display the spatial stereoscopic effect.

SUMMARY OF THE INVENTION

In view of the above, the present application provides an RGB light strips display method, device and computer readable storage medium, so as to solve the problem that the above-mentioned existing display screens are mostly based on dot matrix array scanning or liquid crystal ranks scanning, and the naked eye intuitive feeling presented to the user is a flat effect, and can not display the spatial stereoscopic effect.

A first aspect of the present application provides an RGB light strips display method for use in an RGB light strips display device, the RGB light strips display device includes a processor, and a rotation driver device connected with the processor and an alternating RGB light strips; the rotation driver device includes a driving motor and a rotation shaft connected to the driving motor; a center of the alternating RGB light strips is fixed to the rotation shaft; the rotation shaft drives the alternating RGB light strips to perform a diameter rotation display at a preset rotation step angle under driving of the driving motor; the alternating RGB light strips is composed of two RGB light strips intersected, the RGB light strips is composed of an odd radius light strip and an even radius light strip, the odd radius light strip displays the odd pixel points in the image to be displayed, and the even radius light strip displays the even pixel points in the image to be displayed; wherein the RGB light strips display method includes performing the following steps with the processor:

establishing a mapping relationship between each odd and even pixel positions in the rotation display area of the alternating RGB light strips and each odd and even pixel points in the image to be displayed, and generating an alternating radius scanning coordinate conversion table; and performing pixel point sampling on the image to be displayed according to the alternating radius scanning coordinate conversion table, and acquiring a chrominance information corresponding to each odd and even pixel positions in the rotation display area;

performing the RGB light strips display data extracting and refreshing according to the current rotational angle of the alternating RGB light strips and the chrominance information corresponding to each odd and even pixel positions in the rotation display area, during the rotation of the alternating RGB light strips.

A second aspect of the present application provides an RGB light strips display device comprises a processor, and a rotation driver device connected with processor and an alternating RGB light strips; the rotation driver device includes a driving motor and a rotation shaft connected to the driving motor; a center of the alternating RGB light strips is fixed to the rotation shaft; the rotation shaft drives the alternating RGB light strips to perform a diameter rotation display at a preset rotation step angle under driving of the driving motor; the alternating RGB light strips is composed of two RGB light strips intersected, the RGB light strips is composed of an odd radius light strip and an even radius light strip, the odd radius light strip displays the odd pixel points in the image to be displayed, and the even radius light strip displays the even pixel points in the image to be displayed; the processor comprising:

a table generating unit, which is configured to establish a mapping relationship between each odd and even pixel positions in the rotation display area of the alternating RGB light strips and each odd and even pixel points in the image to be displayed, and generate an alternating radius scanning coordinate conversion table;

a sampling unit, which is configured to perform pixel point sampling on the image to be displayed according to the alternating radius scanning coordinate conversion table, and acquire a chrominance information corresponding to each odd and even pixel positions in the rotation display area;

a display control unit, which is configured to perform the RGB light strips display data extracted and refreshed according to the current rotational angle of the alternating RGB light strips and the chrominance information corresponding to each odd and even pixel positions in the rotation display area, during the rotation of the alternating RGB light strips.

A third aspect of the present application provides an RGB light strips display device, comprising: a memory, a processor, and a computer program stored in the memory and operable on the processor, wherein when the processor executes the computer program, the steps of the method as described in the first aspect above are implemented.

A fourth aspect of the present application provides a computer readable storage medium storing a computer program, wherein the computer program is executed by a processor to implement the steps of the method as described in the first aspect above.

The present application firstly establishes a mapping relationship between each odd and even pixel positions in the rotation display area of the alternating RGB light strips and each odd and even pixel points in the image to be displayed, and generates an alternating radius scanning coordinate conversion table; wherein the alternating RGB light strips is composed of two RGB light strips intersected, the RGB light strips is composed of an odd radius light strip and an even radius light strip, the odd radius light strip is used to display odd pixel points in the image to be displayed, the even radius light strip is used to display the even pixel points in the image to be displayed; and then, according to the alternating radius scanning coordinate conversion table, the pixel point sampling is performed on the image to be displayed to obtain the displayed chrominance information corresponding to the each odd and even pixel positions in the rotation display area; finally, in the process of rotating the alternating RGB light strips, according to the current rotational angle of the alternating RGB light strips and the displayed chrominance information corresponding to the each odd and even pixel positions in the rotation display area to extract and refresh the RGB light strips display data, thereby bringing a stereoscopic and cool experience to people's naked-eye visual effects, and enhance the user's visual experience. In addition, due to the use of alternating RGB light strips for radius rotation scanning, the resolution of the displayed image can be quadrupled.

BRIEF DESCRIPTION OF THE DRAWINGS

In order to make the technical solutions in the embodiments of the present application clearer, the accompanying drawings to be used in the embodiments and the description of the prior art will be briefly introduced below, it is apparent that the drawings in the following description are merely some embodiments of the present application and that other drawings may be obtained by those skilled in the field without departing from the inventive nature of the present application.

DETAILED DESCRIPTION OF THE PREFERRED EMBODIMENTS

In the following description, for purposes of illustration and not for limitation, specific details such as specific system structure, technology, etc. are presented for deeply understanding the present application. It will be apparent to those skilled in the art that the present application may be practiced in other embodiments without these specific details. In other instances, detailed descriptions of well-known systems, devices, circuits, and methods are omitted so as not to obscure the description of the present application.

In order to explain the technical solutions described in the present application, the following description will be made by way of specific embodiments.

Figure 1:
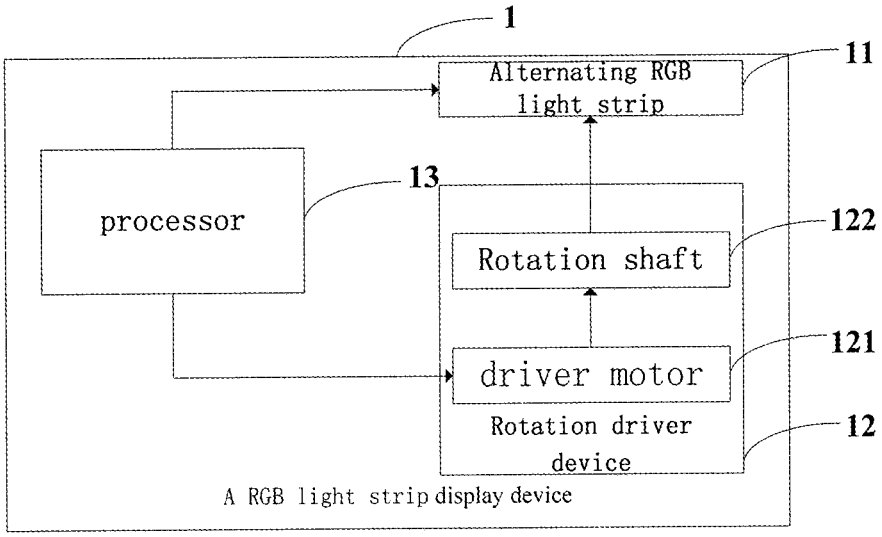
FIG. 1 is a schematic structural diagram of an RGB light strips display device according to an embodiment of the present application.

FIG. 1 is a schematic structural diagram of a device for displaying an RGB light strips according to an embodiment of the present application. Only the parts related to the present embodiment are shown for convenience of explanation.

Referring to FIG. 1, the device 1 for displaying the RGB light strips provided by the embodiment includes a processor 13, a rotating driving device 12 connected to the processor 13, and an alternating RGB light strips 11; the rotating driving device 12 includes a driving motor 121 and a rotation shaft 122 connected to the driving motor 121; a center of the alternating RGB light strips 11 is fixed on the rotation shaft 122; and the rotation shaft 122 is driven by the driving motor 121 to drive the alternating RGB light strips 11 rotating at a preset rotational step angle.

Wherein, the driving motor 121 is driven by the processor 13 to drive the rotation shaft 122 to rotate the alternating RGB light strips 11 in a clockwise or counterclockwise direction according to the preset rotational step angle. Each time the alternating RGB light strips 11 is rotated by an angle, the processor 13 acquires the current rotational angle position of the alternating RGB light strips, and refreshes the display data thereof according to the current rotational angle position of the alternating RGB light strips 11.

The alternating RGB light strips 11 is composed of two RGB light strips, the RGB light strips includes a lamp pole and a plurality of RGB lamps linearly fixed on the lamp pole, and the processor 13 can control the chrominance value displayed by the RGB lamp by PWM technology. Preferably, in a preferred embodiment example, the midpoints of the two RGB light strips in the alternating RGB light strips intersected, and the angle $\beta$ between the two RGB light strips is 90 degrees.

Figure 2:
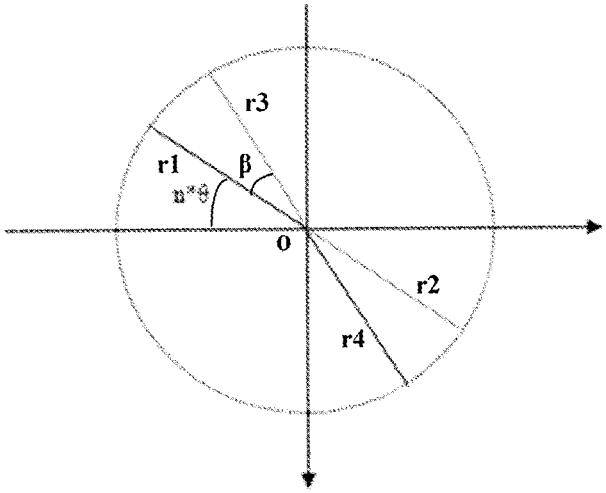
FIG. 2 is a schematic structural diagram of an alternating RGB light strips in an RGB light strips display device according to an embodiment of the present application.
Figure 3:
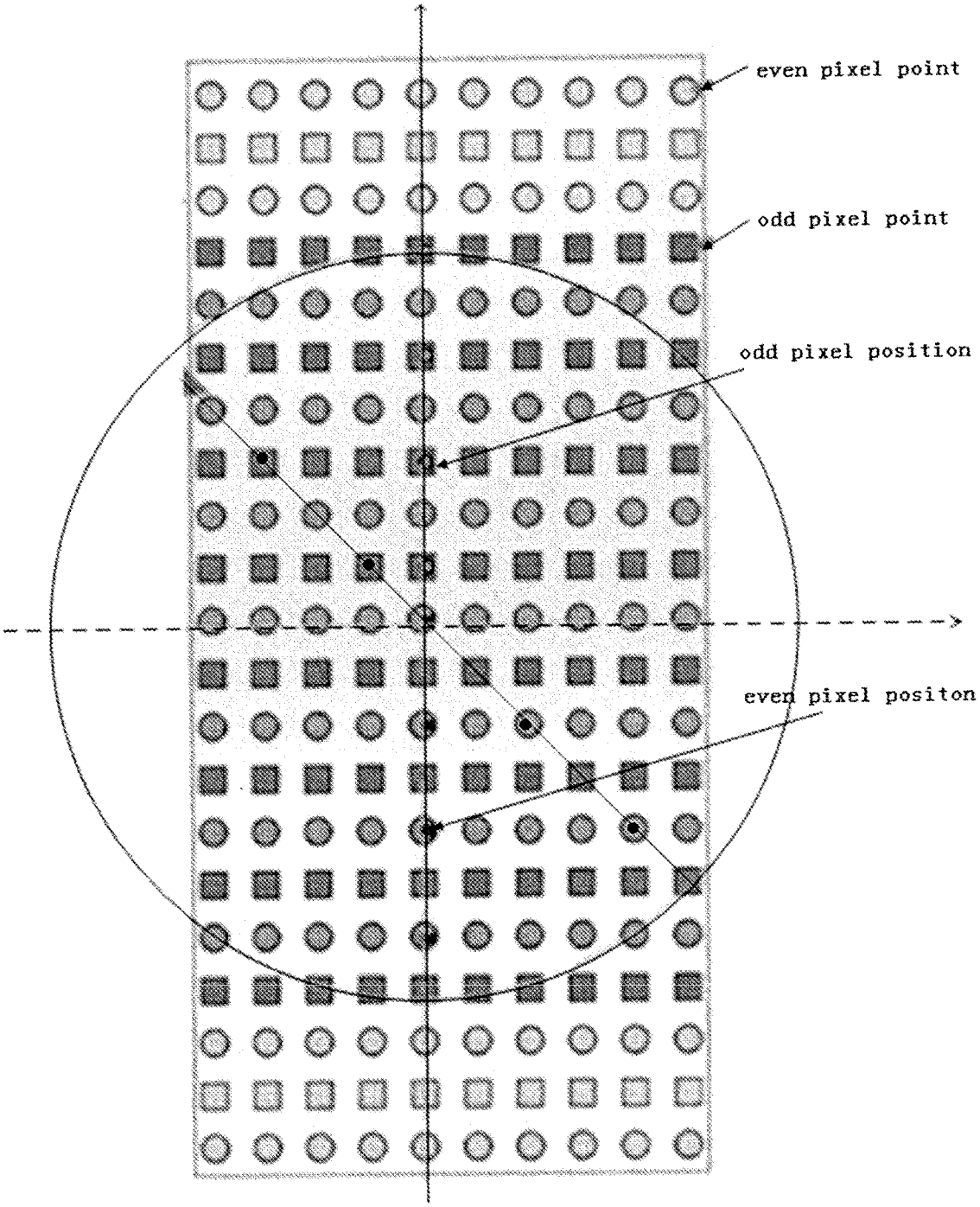
FIG. 3 is a schematic diagram of odd and even pixel positions scanned by an alternating sampling rotating alternating RGB light strips scan according to an embodiment of the present application.

Further, referring to FIG. 2, in the embodiment, the RGB lamps linearly fixed on the lamp post on the two RGB light strips are equally divided into odd radius strips r1, r3 and even radius strips r2 and r4, the odd radius strips r1 and r3 display odd pixel points in the image to be displayed, and the even radius strips r2 and r4 display the even pixel points in the image to be displayed. A schematic diagram of the scanning and sampling rule of the odd radius light strips r1, r3 and the even radius strips r2 and r4 can be seen in FIG. 3, wherein a large circle represents the even pixel point in the image to be displayed, and a square represents the odd pixel points in the image to be displayed, the two radius RGB light strips located on the upper semicircular portion of the rotation display area are the odd radius strips r1, r3, which displacement sampling the odd pixel points in the image to be displayed, and the small circle shown in the upper semicircular portion of the rotation display area represents the odd pixel position of sampling of the odd radius lamp with r1 and r3; the two radius RGB light strips located in the lower semicircular portion of the rotation display area are the even radius strips r2 and r4, which displacement sampling the even pixel points in the image to be displayed, the small circle shown in the lower semicircular portion of the rotation display area represents the even pixel position of sampling of the even radius light strip r2, r4.

The implementation process of the RGB light strips display method provided by the embodiment of the present application is described in detail below based on the RGB light strips display device shown in FIG. 1.

Figure 4:
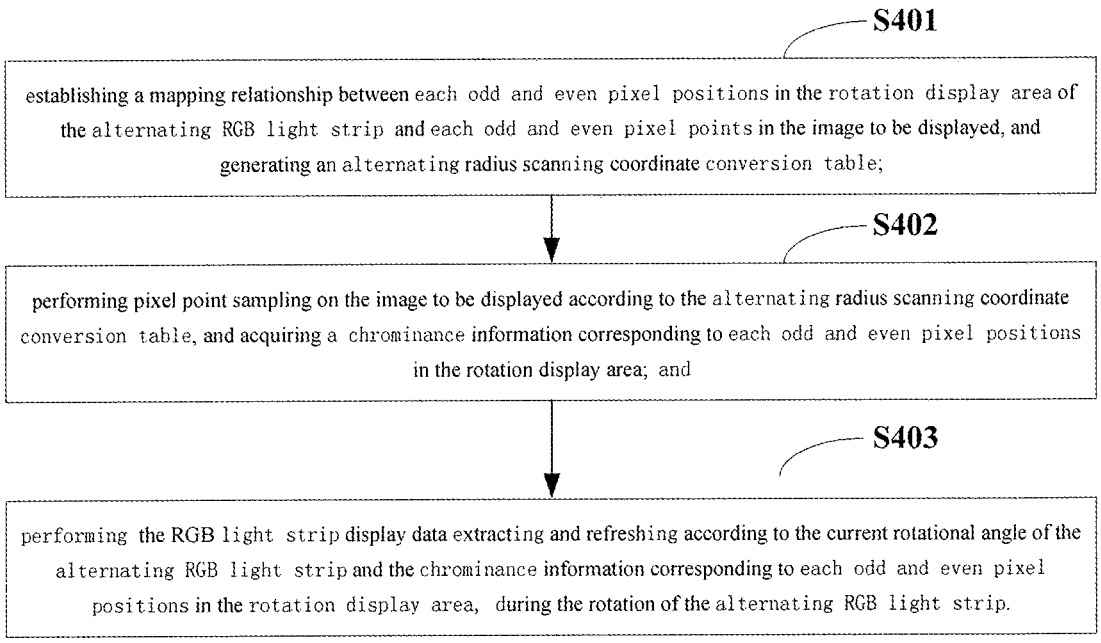
FIG. 4 is a schematic flowchart of an implementation process of an RGB light strips display method according to an embodiment of the present application.

Referring to FIG. 4, a schematic flowchart of an implementation process of an RGB light strips display method according to an embodiment of the present application is shown. The execution body of the method is a processor in the RGB light strips display device shown in FIG. 1. As shown in FIG. 4, the RGB light strips display method provided by this embodiment may include the following steps:

In step S401, establishing a mapping relationship between each odd and even pixel positions in the rotation display area of the alternating RGB light strips and each odd and even pixel points in the image to be displayed, and generating an alternating radius scanning coordinate conversion table.

Figure 5:
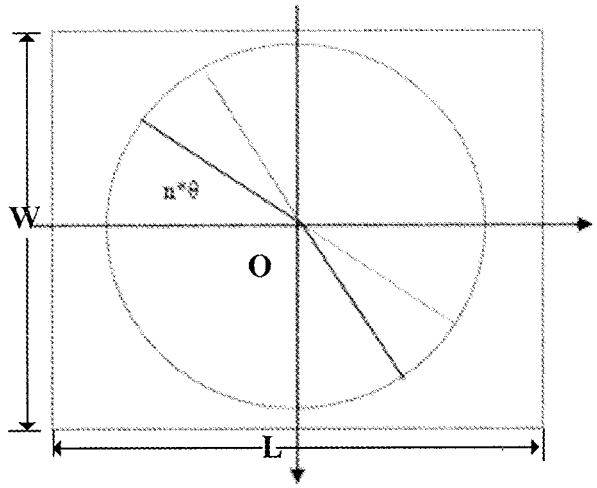
FIG. 5 is a schematic diagram of a memory extraction coordinate system in an RGB light strips display method according to an embodiment of the present application.

FIG. 5 shows a schematic diagram of a memory extraction coordinate system. Referring to FIG. 5, in the embodiment, the rotation display area is a circular area using the length of the RGB light strips of the alternating RGB light strips as the diameter, and the centre of the alternating RGB light strips as center of the circle, the image to be displayed is a rectangular area having a length L and a width W. Among them, $n*\theta$ is the pixel sampling precision of the alternating RGB light strips.

Each of the odd pixel positions in the rotation display area means that when the alternating RGB light strips are rotated at a preset step rotational angle, the position of each RGB light strips of the odd radius light strips on the RGB light strips at each rotational angles.

Each of the even pixel positions in the rotation display area means that when the alternating RGB light strips are rotated at a preset step rotational angle, the position of each RGB light strips of the even radius light strips on the RGB light strips at each rotational angles.

In a specific application, if the area of the image to be displayed is larger than the area of the rotation display area, and outside the rotation display area adopts abandon pixel processing; if the area of the image to be displayed is smaller than the area of the rotation display area, the RGB lamps of the RGB light strips outside the area of the image to be displayed are not illuminated.

Preferably, in a specific application, step S401 specifically includes:

dividing pixel points in the image to be displayed into odd pixel points and even pixel points according to the number of rows of pixels in the image to be displayed;

obtaining coordinate values of each odd and even pixel points in the image to be displayed in the plane rectangular coordinate system;

converting coordinate values of each odd and even pixel points in the image to be displayed into a polar coordinate value by coordinate transformation;

establishing a polar coordinate system with the center of the alternating RGB light strips being a pole;

obtaining a polar coordinate value of each odd and even pixel positions in the polar coordinate system in the alternating RGB light strips rotation display area according to the rotation step angle and the angle of the alternating RGB light strips;

establishing a mapping relationship between each odd and even pixel positions and pixel points on image to be displayed to generate an alternating radius scanning coordinate conversion table according to the polar coordinate values of the each odd and even pixel points in the image to be displayed and the polar coordinate values of the each odd and even pixel positions in the rotation display area.

Preferably, in another specific application, step S401 specifically includes:

establishing a plane rectangular coordinate system with the center of the image to be displayed being the origin, the length direction of the image to be displayed being the X-axis, and the width direction of the image to be displayed being the Y-axis;

dividing pixel points in the image to be displayed into odd pixel points and even pixel points according to the number of rows of pixels in the image to be displayed;

obtaining coordinate values of each odd and even pixel points in the image to be displayed in the plane rectangular coordinate system;

establishing a polar coordinate system with the center of the alternating RGB light strips being a pole;

obtaining a polar coordinate value of each odd and even pixel positions in the polar coordinate display in the alternating RGB light strips rotation display area according to the rotation step angle and the alternating RGB light strips;

converting the polar coordinate value of each odd and even pixel positions in the rotation display area into a coordinate value by coordinate transformation;

establishing a mapping relationship between each odd and even pixel positions and pixel points on image to be displayed to generate an alternating radius scanning coordinate conversion table according to the polar coordinate values of the each odd and even pixel points in the image to be displayed and the polar coordinate values of the each odd and even pixel positions in the rotation display area.

In step S402, performing pixel point sampling on the image to be displayed according to the alternating radius scanning coordinate conversion table, and acquiring chrominance information corresponding to each odd and even pixel positions in the rotation display area.

In this embodiment, after acquiring the alternating radius scanning coordinate conversion table, the processor may acquire the corresponding odd and even pixel positions in the rotation display area according to the alternating radius scanning coordinate conversion table. And then, acquiring chrominance information of the pixel point in the image to be displayed according to the pixel point coordinate, and associating the chrominance information with a corresponding pixel position in the rotation display area and saved it for controlling display of the RGB lamp according to the chrominance information corresponding to the pixel position when the RGB lamp of the alternating RGB light strips is rotated to the pixel position.

In step S403, performing extracting and refreshing of display data of RGB light strips according to the current rotational angle of the alternating RGB light strips and the chrominance information corresponding to each odd and even pixel positions in the rotation display area, in the process of rotating the alternating RGB light strips.

In this embodiment, the alternating RGB light strips is rotated by the preset rotation step angle under the driving of the rotation shaft, and when the alternating RGB light strips is rotated by one step angle, the current rotational angle of the alternating RGB light strips is read once by the processor, and then the current pixel position of each RGB lamp on the odd and even radius light strips is determined according to the current rotational angle of the alternating RGB light strips, according to the current pixel position of the each RGB lamps and chrominance information of display corresponding to each pixel positions in the rotation display area, and using the obtained chrominance information corresponding to each RGB light strips to refresh the display data of the alternating RGB light strips at last, so that after the alternating RGB light strips is rotated 360 degrees, the display device can present the image to be displayed to the user with the naked eye stereoscopic display effect, thereby improving the user's visual experience. In addition, since the diameter displacement light strip rotation scanning mode is adopted in the embodiment, the resolution of the displayed image can be doubled.

As can be seen from the above, the RGB light strips display method provided by the embodiment first establishing the mapping relationship between each odd and even pixel positions in the rotation display area of the alternating RGB light strips and the odd and even pixel points in the image to be displayed, and generating an alternating radius scanning coordinate conversion table; wherein the alternating RGB light strips is composed of two RGB light strips intersected, the RGB light strips is composed of an odd radius light strip and an even radius light strip, the odd radius light strip displays the odd pixel point in the image to be displayed, the even radius light strip displays an even pixel point in the image to be displayed; and then, according to the alternating radius scanning coordinate conversion table to perform pixel point sampling on the image to be displayed and obtain chrominance information corresponding to each odd and even pixel positions in the rotation display area; finally, in the process of rotating the alternating RGB light strips, the extraction and refreshing of the display data is performed according to the current rotational angle of the alternating RGB light strips and the chrominance information corresponding to each odd and even pixel positions in the rotation display area, which can bring stereoscopic and cool experience to people's naked-eye visual effects and enhance the user's visual experience, since the diameter displacement light strip rotation scanning mode is adopted in the embodiment, the resolution of the displayed image can be quadruple.

Figure 6:
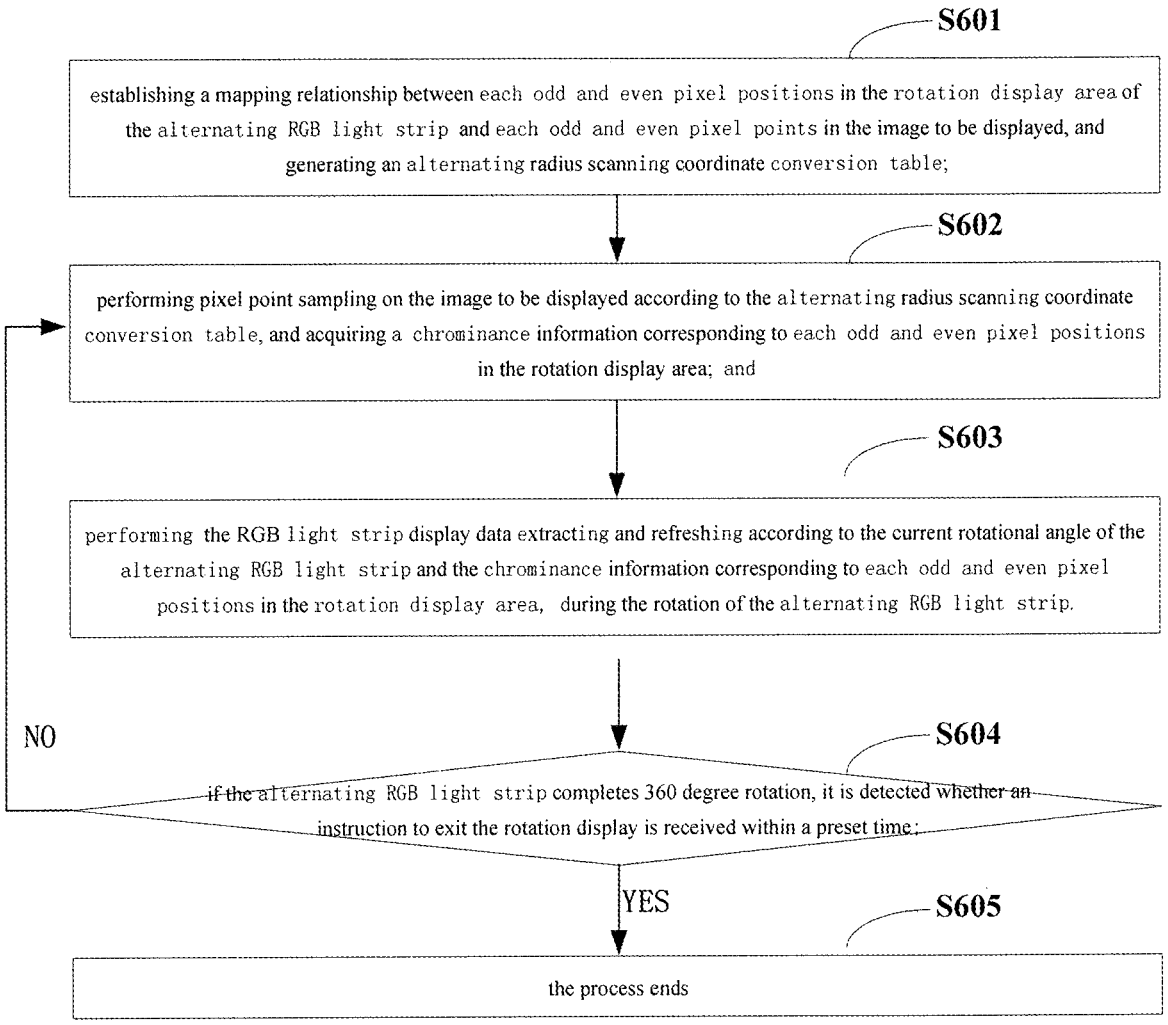
FIG. 6 is a schematic diagram showing an implementation flow of an RGB light strips display method according to another embodiment of the present application.

FIG. 6 is a schematic diagram showing an implementation flow of an RGB light strips display method according to another embodiment of the present application. The main body of the method is the processor in the RGB light strips display device of FIG. 1. As shown in FIG. 6, steps S601 to S603 in this embodiment are completely the same as steps S601 to S603 in the previous embodiment, and thus are not described herein again. With respect to the previous embodiment, the RGB light strips display method provided by the embodiment further includes after step S603:

In step S604, if the alternating RGB light strips completes 360 degree rotation, it is detected whether an instruction to exit the rotation display is received within a preset time, and if the instruction to exit the rotation display is not received within a preset time, then returning to the step S602; If the instruction to exit the rotation is received, proceeding to step S605;

In step S605, the process ends.

In this embodiment, when the alternating RGB light strips completes 360 degree rotation, it indicates that the display device completes a rotation cycle display at this time, and if the instruction to exit the rotation display is not received within the preset time, then re-enter to the process of extracting and refreshing pixels of pixel points in the image to be displayed corresponding to each odd and even pixel positions in the rotation display area, and continue to be rotation displayed. If the 360 degree rotation is not completed, step S603 is continued.

Compared with the previous embodiment, the RGB light strips display method provided by the embodiment, if the instruction to exit the rotation display is not detected within the preset time after the 360-degree rotation of the light strip is completed, then re-enter to the process of extracting and refreshing pixels of pixel points in the image to be displayed corresponding to each odd and even pixel positions in the rotation display area continues to be rotated, which can bring a dynamic stereoscopic display effect to the naked-eye visual, further improving the user's visual experience.

Figure 7:
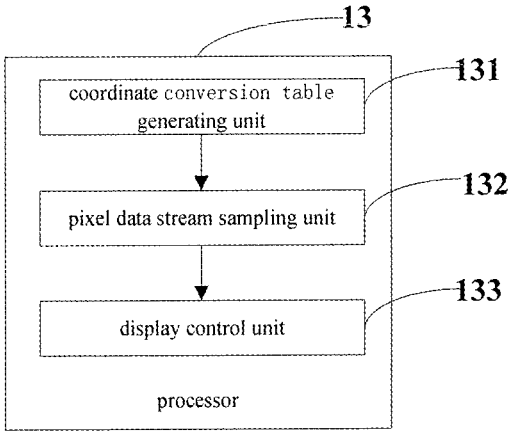
FIG. 7 is a schematic structural diagram of a processor in a device for displaying an RGB light strips according to an embodiment of the present application.

FIG. 7 is a schematic structural diagram of a processor in a device for displaying an RGB light strips according to an embodiment of the present application. Only the parts related to the present embodiment are shown for convenience of explanation.

Referring to FIG. 7, in this embodiment, the processor 13 includes:

a table generating unit 131, which is configured to establish a mapping relationship between each odd and even pixel positions in the rotated RGB light strips rotation display area and each odd and even pixel points in the image to be displayed, and to generate an alternating radius scanning coordinate conversion table;

a sampling unit 132, which is configured to perform pixel point sampling on the image to be displayed according to the alternating radius scanning coordinate conversion table, and to acquire a chrominance information corresponding to each odd and even pixel positions in the rotation display area;

a display control unit 133, which is configured to perform extraction and refreshing of the RGB light strips display data according to a current rotational angle of the alternating RGB light strips and chrominance information corresponding to each odd and even pixel positions in the rotation display area, during the process rotating the alternating RGB light strips.

Optionally, the table generating unit 131 is specifically configured to:

establishing a plane rectangular coordinate system with the center of the image to be displayed being the origin, the length direction of the image to be displayed being the X-axis, and the width direction of the image to be displayed being the Y-axis;

dividing pixel points in the image to be displayed into odd pixel points and even pixel points according to the number of rows of pixels in the image to be displayed;

obtaining coordinate values of each odd and even pixel points in the image to be displayed in the plane rectangular coordinate system;

converting coordinate values of each odd and even pixel points in the image to be displayed into a polar coordinate value by coordinate transformation;

establishing a polar coordinate system with the center of the alternating RGB light strips being a pole;

obtaining a polar coordinate value of each odd and even pixel positions in the polar coordinate system in the alternating RGB light strips rotation display area according to the rotation step angle and the angle of the alternating RGB light strips; and establishing a mapping relationship between each odd and even pixel positions and pixel points on image to be displayed to generate an alternating radius scanning coordinate conversion table according to the polar coordinate values of the each odd and even pixel points in the image to be displayed and the polar coordinate values of the each odd and even pixel positions in the rotation display area.

Optionally, the table generating unit 131 is specifically configured to:

establishing a plane rectangular coordinate system with the center of the image to be displayed being the origin, the length direction of the image to be displayed being the X-axis, and the width direction of the image to be displayed being the Y-axis;

dividing pixel points in the image to be displayed into odd pixel points and even pixel points according to the number of rows of pixels in the image to be displayed;

obtaining coordinate values of each odd and even pixel points in the image to be displayed in the plane rectangular coordinate system;

establishing a polar coordinate system with the center of the alternating RGB light strips being a pole;

obtaining a polar coordinate value of each odd and even pixel positions in the polar coordinate system in the alternating RGB light strips rotation display area according to the rotation step angle and the angle of the alternating RGB light strips;

converting the polar coordinate value of each odd and even pixel positions in the rotation display area into a coordinate value by coordinate transformation; and establishing a mapping relationship between each odd and even pixel positions and pixel points on image to be displayed to generate an alternating radius scanning coordinate conversion table according to the polar coordinate values of the each odd and even pixel points in the image to be displayed and the polar coordinate values of the each odd and even pixel positions in the rotation display area.

Figure 8:
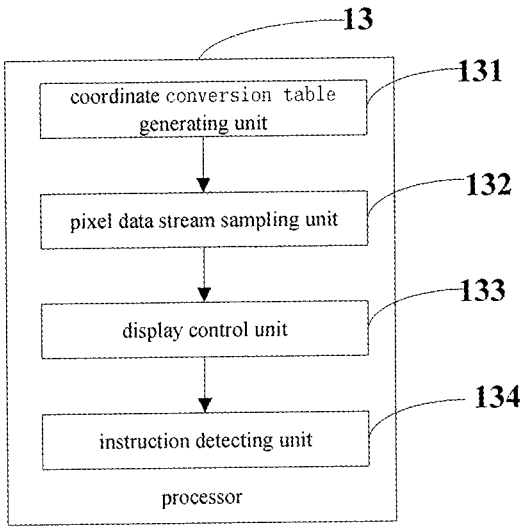
FIG. 8 is a schematic structural diagram of a processor in a device for displaying an RGB light strips according to another embodiment of the present application.

Optionally, referring to FIG. 8, in another embodiment, the processor 13 further includes an instruction detecting unit 134 for:

detecting whether an instruction to exit the rotation display is received within a preset time, if the alternating RGB light strips completes 360 degree rotation;

controlling the sampling unit to perform pixel point sampling on the image to be displayed according to the alternating radius scanning coordinate conversion table, and obtaining chrominance information displayed corresponding to each odd and even pixel positions in the rotation display area, if the instruction to exit the rotation is not received within the preset time;

turning off the function of rotation display of the RGB light strips display device, If an instruction to exit the rotation display is received.

It is to be noted that the various units in the foregoing device provided by the embodiments of the present application are based on the same concept as the method embodiment of the present application, and the technical effects thereof are the same as the method embodiments of the present application. For details, referring to the method embodiment of the present application. It is not repeatedly described herein.

Therefore, it can be seen that the RGB light strips display device provided by the embodiment of the present application can also bring stereoscopic and cool experience to people's naked-eye visual effects and enhance the user's visual experience. since the alternating light strip rotation scanning is adopted in the embodiment, the resolution of the displayed image can be quadruple.

It should be understood that the order of the sequence of the steps in the above embodiments does not mean that the order of execution. The order of execution of each process should be determined by its function and internal logic, and should not be construed as limiting the implementation process of the embodiments of the present application.

Figure 9:
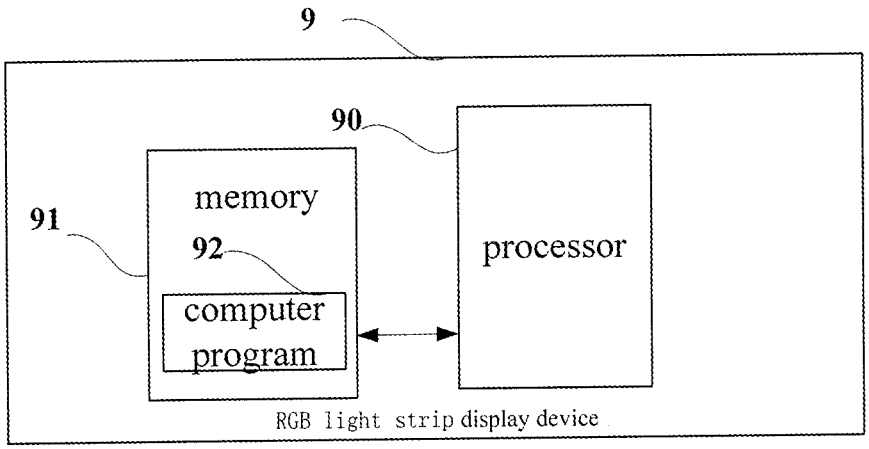
FIG. 9 is a schematic structural diagram of a device for displaying an RGB light strips according to still another embodiment of the present application.

FIG. 9 is a schematic diagram of a device for displaying an RGB light strips according to still another embodiment of the present application. As shown in FIG. 9, the RGB light strips display device 9 of this embodiment includes a processor 90, a memory 91, and a computer program 92 stored in the memory 91 and operable on the processor 90. The processor 90 executes the computer program 92 to implement the steps in the various method embodiments described above, such as steps 401 to 403 shown in FIG. 4. Alternatively, when the processor 90 executes the computer program 92, the functions of the units in the above described each device embodiments are implemented, such as the functions of the modules 131 to 133 shown in FIG. 7.

Illustratively, the computer program 92 can be divided into one or more modules/units that are stored in the memory 91 and executed by the processor 90 to complete this application. The one or more modules/units may be a series of computer program instructions that are capable of performing a particular function for describing the process of executing the computer program 92 in the RGB light strips display device 9. For example, the computer program 92 may be divided into a behavior coordinate conversion table generating unit 131, a generating unit 132, and a display control unit 133, and the specific functions of each unit are as follows:

the table generating unit 131, which is configured to establish a mapping relationship between each odd and even pixel positions in the rotated RGB light strips rotation display area and each odd and even pixel points in the image to be displayed, and to generate a cross misalignment radius scan coordinate conversion table;

the sampling unit 132, which is configured to scan a coordinate conversion table according to the intersection misalignment radius, to perform pixel point sampling on the image to be displayed, and to acquire a chrominance corresponding to each odd and even pixel positions in the rotation display area information;

the display control unit 133, which is configured to display according to a current rotational angle of the alternating RGB light strips and chrominance information corresponding to each odd and even pixel positions in the rotation display area, during the rotating of the alternating RGB light strips, RGB light strips display data extraction and refresh.

the RGB light strips display device may include, but is not limited to, a processor 90 and a memory 91. It will be understood by persons skilled in the art that FIG. 9 is merely an example of the RGB light strips display device 9, and does not constitute a limitation to the terminal device 9, and may include more or less components than those illustrated, or a combination of some components, or different components, such as the RGB light strips display device 9 may also include an input and output device, a network access device, a bus, etc.

The processor 90 may be a central processing unit (CPU), or may be other general purpose processors, a digital signal processor (DSP), an application specific integrated circuit (ASIC), Field-Programmable Gate Array (FPGA) or other programmable logic device, discrete gate or transistor logic device, discrete hardware components, etc. The general purpose processor may be a microprocessor or the processor of any conventional processor or the like.

The memory 91 may be an internal storage unit of the RGB light strips display device 9, such as a hard disk or memory of the RGB light strips display device 9. The memory 91 may also be an external storage device of the RGB light strips display device 9, for example, the RGB light strips display device 9 is equipped with a plug-in hard disk, Smart Media Card (SMC), Secure Digital (SD) card, Flash Card, etc. Further, the memory 91 may also include an internal storage unit of the RGB light strips display device 9 and an external storage device. The memory 91 is used to store the computer program and other programs and data required by the terminal. The memory 91 can also be used to temporarily store data that has been output or is about to be output.

It can be clearly understood by the persons skilled in the art that, for describing conveniently and concisely, dividing of the aforesaid various functional units, functional modules is described exemplarily merely, in an actual application, the aforesaid functions can be assigned to different functional units and functional modules to be accomplished, that is, an inner structure of a data synchronizing device is divided into functional units or modules so as to accomplish the whole or a part of functionalities described above. The various functional units, modules in the embodiments can be integrated into a processing unit, or each of the units exists independently and physically, or two or more than two of the units are integrated into a single unit. The aforesaid integrated unit can by either actualized in the form of hardware or in the form of software functional units. In addition, specific names of the various functional units and modules are only used for distinguishing from each other conveniently, but not intended to limit the protection scope of the present application. Regarding a specific working process of the units and modules in the aforesaid device, reference can be made to a corresponding process in the aforesaid method embodiments, it is not repeatedly described herein.

In the aforesaid embodiments, the description of each of the embodiments is emphasized respectively, regarding a part of one embodiment which isn't described or disclosed in detail, please refer to relevant descriptions in some other embodiments.

Persons skilled in the art may aware that, the elements and algorithm steps of each of the examples described in connection with the embodiments disclosed herein can be implemented in electronic hardware, or in combination with computer software and electronic hardware. Whether these functions are implemented by hardware or software depends on the specific application and design constraints of the technical solution. The skilled people could use different methods to implement the described functions for each particular application, however, such implementations should not be considered as going beyond the scope of the present application.

It should be understood that, in the embodiments of the present application, the disclosed device/terminal device and method could be implemented in other ways. For example, the device described above are merely illustrative; for example, the division of the units is only a logical function division, and other division could be used in the actual implementation, for example, multiple units or components could be combined or integrated into another system, or some features can be ignored, or not performed. In another aspect, the coupling or direct coupling or communicating connection shown or discussed could be an indirect, or a communicating connection through some interfaces, devices or units, which could be electrical, mechanical, or otherwise.

The units described as separate components could or could not be physically separate, the components shown as units could or could not be physical units, which can be located in one place, or can be distributed to multiple network elements. Parts or all of the elements could be selected according to the actual needs to achieve the object of the present embodiment.

In addition, the various functional units in each of the embodiments of the present application can be integrated into a single processing unit, or exist individually and physically, or two or more than two units are integrated into a single unit. The aforesaid integrated unit can either be achieved by hardware, or be achieved in the form of software functional units.

If the integrated unit is achieved in the form of software functional units, and is sold or used as an independent product, it can be stored in a computer readable storage medium. Based on this understanding, a whole or part of flow process of implementing the method in the aforesaid embodiments of the present application can also be accomplished by using computer program to instruct relevant hardware. When the computer program is executed by the processor, the steps in the various method embodiments described above can be implemented. Wherein, the computer program comprises computer program codes, which can be in the form of source code, object code, executable documents or some intermediate form, etc. The computer readable medium can include: any entity or device that can carry the computer program codes, recording medium, USB flash disk, mobile hard disk, hard disk, optical disk, computer storage device, ROM (Read-Only Memory), RAM (Random Access Memory), electrical carrier signal, telecommunication signal and software distribution medium, etc. It needs to be explained that, the contents contained in the computer readable medium can be added or reduced appropriately according to the requirement of legislation and patent practice in a judicial district, for example, in some judicial districts, according to legislation and patent practice, the computer readable medium doesn't include electrical carrier signal and telecommunication signal.

As stated above, the aforesaid embodiments are only intended to explain but not to limit the technical solutions of the present application. Although the present application has been explained in detail with reference to the above-described embodiments, it should be understood for the ordinary skilled one in the art that, the technical solutions described in each of the above-described embodiments can still be amended, or some technical features in the technical solutions can be replaced equivalently; these amendments or equivalent replacements, which won't make the essence of corresponding technical solution to be broken away from the spirit and the scope of the technical solution in various embodiments of the present application, should all be included in the protection scope of the present application.

What is claimed is:

1. A RGB light strips display method for applying in a RGB light strips display device, wherein the RGB light strips display device comprises a processor, and a rotation driver device connected with the processor and an alternating RGB light strips; the rotation driver device includes a driving motor and a rotation shaft connected to the driving motor; a center of the alternating RGB light strips is fixed to the rotation shaft; the rotation shaft drives the alternating RGB light strips to perform a diameter rotation display at a preset rotation step angle under driving of the driving motor; the alternating RGB light strips is composed of two RGB light strips intersected, the RGB light strips is composed of an odd radius light strip and an even radius light strip, the odd radius light strip displays the odd pixel points in the image to be displayed, and the even radius light strip displays the even pixel points in the image to be displayed; wherein the RGB light strips display method includes performing the following steps with the processor:

establishing a mapping relationship between each odd and even pixel positions in the rotation display area of the alternating RGB light strips and each odd and even pixel points in the image to be displayed, and generating an alternating radius scanning coordinate conversion table;

performing pixel point sampling on the image to be displayed according to the alternating radius scanning coordinate conversion table, and acquiring a chrominance information corresponding to each odd and even pixel positions in the rotation display area; and performing the RGB light strips display data extracting and refreshing according to the current rotational angle of the alternating RGB light strips and the chrominance information corresponding to each odd and even pixel positions in the rotation display area, during the rotation of the alternating RGB light strips.

2. The method of claim 1, wherein the establishing a mapping relationship between each odd and even pixel positions in the rotation display area of the alternating RGB light strips and each odd and even pixel points in the image to be displayed, and generating an alternating radius scanning coordinate conversion table comprises:

establishing a plane rectangular coordinate system with the center of the image to be displayed being the origin, the length direction of the image to be displayed being the X-axis, and the width direction of the image to be displayed being the Y-axis;

dividing pixel points in the image to be displayed into odd pixel points and even pixel points according to the number of rows of pixels in the image to be displayed;

obtaining coordinate values of each odd and even pixel points in the image to be displayed in the plane rectangular coordinate system;

converting coordinate values of each odd and even pixel points in the image to be displayed into a polar coordinate value by coordinate transformation;

establishing a polar coordinate system with the center of the alternating RGB light strips being a pole;

obtaining a polar coordinate value of each odd and even pixel positions in the polar coordinate system in the alternating RGB light strips rotation display area according to the rotation step angle and the angle of the alternating RGB light strips; and establishing a mapping relationship between each odd and even pixel positions and pixel points on image to be displayed to generate an alternating radius scanning coordinate conversion table according to the polar coordinate values of the each odd and even pixel points in the image to be displayed and the polar coordinate values of the each odd and even pixel positions in the rotation display area.

3. The method of claim 1, wherein the establishing a mapping relationship between each odd and even pixel positions in the rotation display area of the alternating RGB light strips and each odd and even pixel points in the image to be displayed, and generating an alternating radius scanning coordinate conversion table comprises:

establishing a plane rectangular coordinate system with the center of the image to be displayed being the origin, the length direction of the image to be displayed being the X-axis, and the width direction of the image to be displayed being the Y-axis;

dividing pixel points in the image to be displayed into odd pixel points and even pixel points according to the number of rows of pixels in the image to be displayed;

obtaining coordinate values of each odd and even pixel points in the image to be displayed in the plane rectangular coordinate system;

establishing a polar coordinate system with the center of the alternating RGB light strips being a pole;

obtaining a polar coordinate value of each odd and even pixel positions in the polar coordinate system in the alternating RGB light strips rotation display area according to the rotation step angle and the angle of the alternating RGB light strips;

converting the polar coordinate value of each odd and even pixel positions in the rotation display area into a coordinate value by coordinate transformation; and establishing a mapping relationship between each odd and even pixel positions and pixel points on image to be displayed to generate an alternating radius scanning coordinate conversion table according to the polar coordinate values of the each odd and even pixel points in the image to be displayed and the polar coordinate values of the each odd and even pixel positions in the rotation display area.

4. The method of claim 2 or 3, wherein an angle between the two RGB light strips in the alternating RGB light strips is 90 degrees.

5. The method of claim 1, wherein after the performing the RGB light strips display data extracting and refreshing according to the current rotational angle of the alternating RGB light strips and the chrominance information corresponding to each odd and even pixel positions in the rotation display area, during the rotation of the alternating RGB light strips further comprising:

if the alternating RGB light strips completes 360 degree rotation, it is detected whether an instruction to exit the rotation display is received within a preset time; and if the instruction to exit the rotation display is not received within a preset time, then returning to the step of performing pixel point sampling on the image to be displayed according to the alternating sampling scanning coordinate conversion table, and acquiring displayed chrominance information corresponding to each odd and even pixel positions in the rotation display area; and if an instruction to exit the rotation is received, the process ends.

6. An RGB light strips display device, comprising:

a processor, a rotation driver device coupled to the processor, and an alternating RGB light strips; the rotation driver device includes a driving motor and a rotation shaft connected to the driving motor;

a center of the alternating RGB light strips is fixed to the rotation shaft; the rotation shaft drives the alternating RGB light strips to perform a diameter rotation display at a preset rotation step angle under driving of the driving motor; the alternating RGB light strips is composed of two RGB light strips intersected, the RGB light strips is composed of an odd radius light strip and an even radius light strip, the odd radius light strip displays the odd pixel points in the image to be displayed, and the even radius light strip displays the even pixel points in the image to be displayed; the processor comprising:

a table-generating unit, which is configured to establish a mapping relationship between each odd and even pixel positions in the rotation display area of the alternating RGB light strips and each odd and even pixel points in the image to be displayed, and generate an alternating radius scanning coordinate conversion table;

a sampling unit, which is configured to perform pixel point sampling on the image to be displayed according to the alternating radius scanning coordinate conversion table, and acquire a chrominance information corresponding to each odd and even pixel positions in the rotation display area;

a display control unit, which is configured to perform the RGB light strips display data extracted and refreshed according to the current rotational angle of the alternating RGB light strips and the chrominance information corresponding to each odd and even pixel positions in the rotation display area, during the rotation of the alternating RGB light strips.

7. The device of claim 6, wherein the table generating unit is specifically configured to:

establishing a plane rectangular coordinate system with the center of the image to be displayed being the origin, the length direction of the image to be displayed being the X-axis, and the width direction of the image to be displayed being the Y-axis;

dividing pixel points in the image to be displayed into odd pixel points and even pixel points according to the number of rows of pixels in the image to be displayed;

obtaining coordinate values of each odd and even pixel points in the image to be displayed in the plane rectangular coordinate system;

converting coordinate values of each odd and even pixel points in the image to be displayed into a polar coordinate value by coordinate transformation;

establishing a polar coordinate system with the center of the alternating RGB light strips being a pole;

obtaining a polar coordinate value of each odd and even pixel positions in the polar coordinate system in the alternating RGB light strips rotation display area according to the rotation step angle and the angle of the alternating RGB light strips; and establishing a mapping relationship between each odd and even pixel positions and pixel points on image to be displayed to generate an alternating radius scanning coordinate conversion table according to the polar coordinate values of the each odd and even pixel points in the image to be displayed and the polar coordinate values of the each odd and even pixel positions in the rotation display area.

8. The device of claim 6, wherein the table generating unit is specifically configured to:

establishing a plane rectangular coordinate system with the center of the image to be displayed being the origin, the length direction of the image to be displayed being the X-axis, and the width direction of the image to be displayed being the Y-axis;

dividing pixel points in the image to be displayed into odd pixel points and even pixel points according to the number of rows of pixels in the image to be displayed;

obtaining coordinate values of each odd and even pixel points in the image to be displayed in the plane rectangular coordinate system;

establishing a polar coordinate system with the center of the alternating RGB light strips being a pole;

obtaining a polar coordinate value of each odd and even pixel positions in the polar coordinate system in the alternating RGB light strips rotation display area according to the rotation step angle and the angle of the alternating RGB light strips;

converting the polar coordinate value of each odd and even pixel positions in the rotation display area into a coordinate value by coordinate transformation; and establishing a mapping relationship between each odd and even pixel positions and pixel points on image to be displayed to generate an alternating radius scanning coordinate conversion table according to the polar coordinate values of the each odd and even pixel points in the image to be displayed and the polar coordinate values of the each odd and even pixel positions in the rotation display area.

9. An RGB light strips display device, comprising:

a memory, a processor, and a computer program stored in the memory and operable on the processor, wherein the processor executes the computer program implements the steps of the method of claim 1.

10. A non-transitory computer readable storage medium storing a computer program, wherein the computer program is executed by a processor to implement the steps of the method of claim 1.

* * * * *